US011454393B2

(12) United States Patent
Cadima

(10) Patent No.: US 11,454,393 B2
(45) Date of Patent: Sep. 27, 2022

(54) GAS BURNER WITH AN OFFSET FLAME PORT ARRAY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 708 days.

(21) Appl. No.: 16/239,691

(22) Filed: Jan. 4, 2019

(65) Prior Publication Data

US 2020/0217502 A1 Jul. 9, 2020

(51) Int. Cl.

| | |
|---|---|
| ***F23D 14/60*** | (2006.01) |
| ***F24C 3/08*** | (2006.01) |
| ***F23D 14/58*** | (2006.01) |

(52) U.S. Cl.

CPC ..... *F23D 14/60* (2013.01); *F23D 14/583* (2013.01); *F24C 3/085* (2013.01); *F23D 2203/1026* (2013.01); *F23D 2208/00* (2013.01)

(58) Field of Classification Search

CPC .. F23D 14/06; F23D 14/46; F23D 2203/1026; F23D 14/60; F23D 14/583; F23D 2208/00; F23D 2900/14062; F24C 3/085

USPC ..... 431/8, 326, 328, 12; 126/1 r, 39 r; 99/324; 239/553, 553.3, 556

See application file for complete search history.

(56) References Cited

U.S. PATENT DOCUMENTS

| | | | | |
|---|---|---|---|---|
| 1,749,385 A * | 3/1930 | Kolts | F23D 14/04 | 239/425.5 |
| 2,253,178 A * | 8/1941 | Hennessy | F23D 14/10 | 239/559 |
| 2,320,754 A * | 6/1943 | Sherman | F23D 14/06 | 126/39 K |
| 2,344,144 A * | 3/1944 | Hobson | F24C 15/107 | 126/39 R |
| 6,092,518 A * | 7/2000 | Dane | F23D 14/06 | 126/214 D |
| 6,655,954 B2 * | 12/2003 | Dane | F24C 3/085 | 126/39 R |
| 8,206,148 B2 * | 6/2012 | Paesani | F23D 14/26 | 431/284 |
| 8,221,116 B2 * | 7/2012 | Biagioli | F23D 14/64 | 431/284 |

(Continued)

FOREIGN PATENT DOCUMENTS

| | | | |
|---|---|---|---|
| BE | 1003479 A3 * | 3/1992 | F23D 14/065 |
| DE | 102005026210 A1 * | 12/2006 | F23D 14/06 |

(Continued)

*Primary Examiner* — Steven B McAllister
*Assistant Examiner* — Daniel E. Namay
(74) *Attorney, Agent, or Firm* — Dority & Manning, P.A.

(57) ABSTRACT

A gas burner includes a burner body that defines a fuel chamber and a plurality of flame ports. The plurality of flame ports are configured for directing a flow of fuel and air out of the fuel chamber. The plurality of flame ports are distributed along a circumferential direction on the burner body such that the plurality of flame ports are uniformly spaced from a center of the fuel chamber along a radial direction. The plurality of flame ports may be oriented to direct flames away from a void within the plurality of flame ports.

17 Claims, 8 Drawing Sheets

(56) References Cited

U.S. PATENT DOCUMENTS

| | | | | |
|---|---|---|---|---|
| 9,206,986 | B2 * | 12/2015 | Jeong | F24C 3/085 |
| 9,995,490 | B2 * | 6/2018 | Cadima | F23D 14/58 |
| 10,330,326 | B2 * | 6/2019 | Cadima | F24C 3/085 |
| 2002/0039713 | A1 * | 4/2002 | Dane | F23D 14/06 431/354 |
| 2005/0056268 | A1 * | 3/2005 | Panchapagesan | F24C 3/085 126/39 E |
| 2014/0041650 | A1 * | 2/2014 | Jeong | F24C 3/085 126/39 E |
| 2016/0025348 | A1 * | 1/2016 | Cadima | F23D 14/06 126/39 E |
| 2016/0102866 | A1 * | 4/2016 | Cadima | F23D 14/06 126/39 E |
| 2018/0142898 | A1 * | 5/2018 | Cadima | F24C 15/107 |
| 2018/0187885 | A1 * | 7/2018 | Manrique | F23N 1/007 |
| 2018/0195718 | A1 * | 7/2018 | Uribe | F23D 14/06 |
| 2018/0306448 | A1 * | 10/2018 | Cadima | F24C 3/085 |

FOREIGN PATENT DOCUMENTS

| | | | | |
|---|---|---|---|---|
| DE | 102005026210 | A1 | 12/2006 | |
| FR | 2814795 | A1 * | 4/2002 | F23D 14/06 |
| KR | 101818822 | B1 * | 1/2018 | F23D 14/32 |

* cited by examiner

GAS BURNER WITH AN OFFSET FLAME PORT ARRAY

FIELD OF THE INVENTION

The present subject matter relates generally to gas cooktops and gas burners for gas cooktops.

BACKGROUND OF THE INVENTION

Conventional gas cooking appliances have one or more burners. A mixture of gaseous fuel and air combusts at the burners to generate heat for cooking. The burners are generally positioned below grates that support cooking utensils over the burners.

Positioning burners below grates poses challenges. In particular, the grates are heated by the burners' flames during operation of the burners. To avoid overheating of the grates, spacing between the burner's flame ports is frequently varied to avoid excessive impingement of flames on the grates. However, as heat transfer rates possible from modern gas burners increase, increasing the spacing between flame ports to prevent excessive heating of the grates adversely affects burner heat output.

BRIEF DESCRIPTION OF THE INVENTION

Aspects and advantages of the invention will be set forth in part in the following description, or may be apparent from the description, or may be learned through practice of the invention.

In a first example embodiment, a gas burner includes a burner body that defines a fuel chamber and a plurality of flame ports. The plurality of flame ports are configured for directing a flow of fuel and air out of the fuel chamber. The plurality of flame ports are distributed along a circumferential direction on the burner body such that the plurality of flame ports are uniformly spaced from a center of the fuel chamber along a radial direction. The plurality of flame ports includes a first flame port polar array and a second flame port polar array. The first and second flame port polar arrays are spaced by a void along the circumferential direction. The first flame port polar array has an origin that is spaced from the center of the fuel chamber. The second flame port polar array has an origin that is spaced from the center of the fuel chamber and from the origin of the first flame port polar array.

In a second example embodiment, a gas burner includes a burner body that defines a fuel chamber and a plurality of flame ports. The plurality of flame ports are configured for directing a flow of fuel and air out of the fuel chamber. The plurality of flame ports are distributed along a circumferential direction on the burner body such that the plurality of flame ports are uniformly spaced from a center of the fuel chamber along a radial direction. The plurality of flame ports includes a first pair of adjacent flame ports and a second pair of adjacent flame ports. The first pair of adjacent flame ports is positioned opposite the second pair of adjacent flame ports about a void along the circumferential direction. Each of the first and second pairs of adjacent flame ports extend along a respective centerline. The centerlines of the first pair of adjacent flame ports intersect at a first point that is spaced from the center of the fuel chamber. The centerlines of the second pair of adjacent flame ports intersect at a second point that is spaced from the center of the fuel chamber and from the first point.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
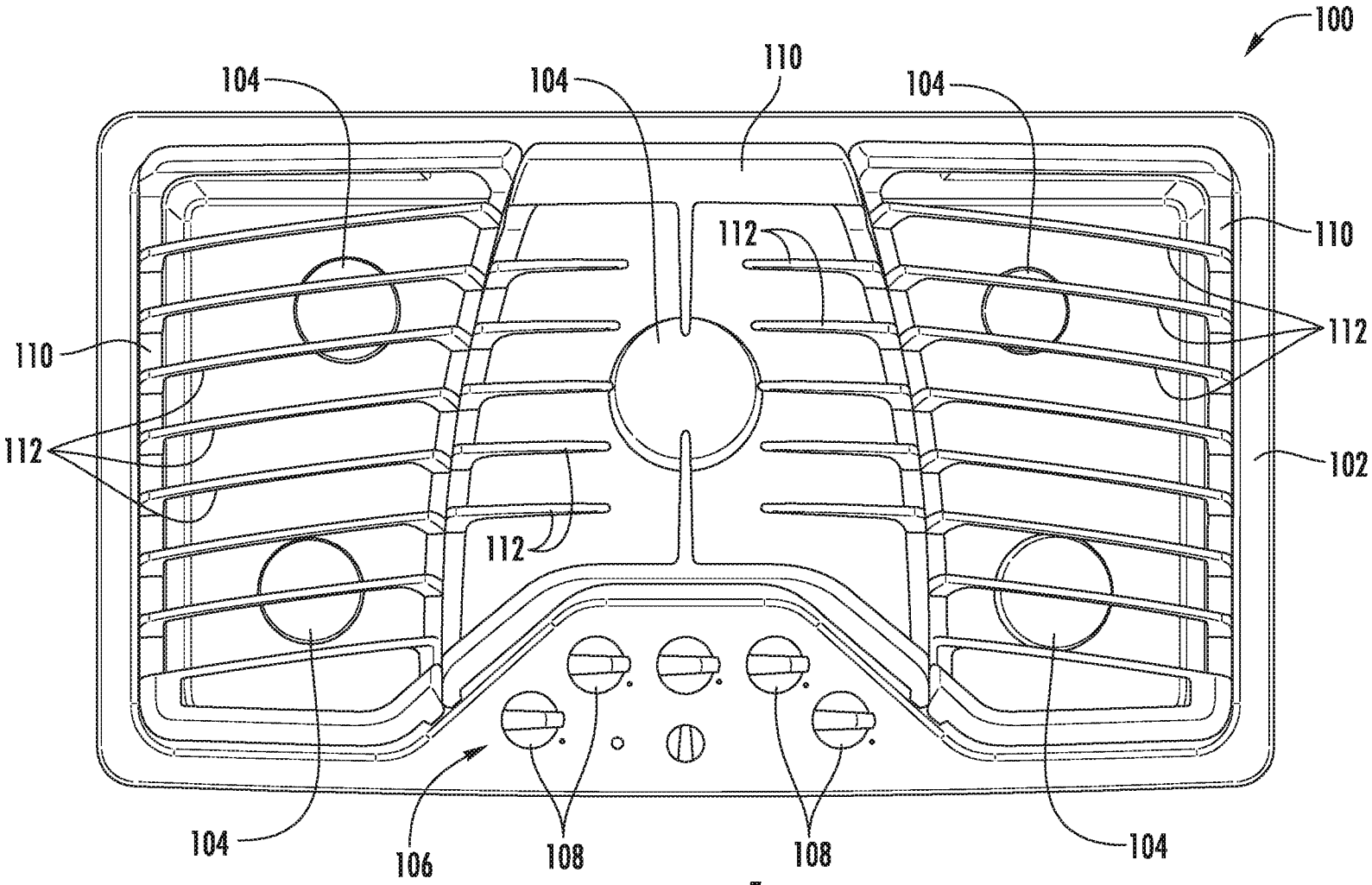
FIG. 1 provides a top, plan view of a cooktop appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 that includes one or more heating sources, such as gas burners 104 for use in, e.g., heating or cooking. In general, top panel 102 may be constructed of any suitably rigid and heat resistant material capable of supporting gas burners 104, cooking utensils, grates 110, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs 108 that are each associated with one of gas burners 104. Control knobs 108 allow the user to activate each gas burner 104 and regulate the amount of heat input each gas burner 104 provides to a cooking utensil located thereon, as described in more detail below. Although cooktop appliance 100 is illustrated as including control knobs 108 for controlling gas burners 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as a "gas cooktop," and one or more of the gas burners in cooktop appliance may include a gas burner 300 described below. As illustrated, gas burners 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Gas burners 104 are positioned underneath the various grates 110 such that gas burners 104 provide thermal energy to cooking utensils above top panel 102 by combustion of fuel below the cooking utensils.

Figure 2:
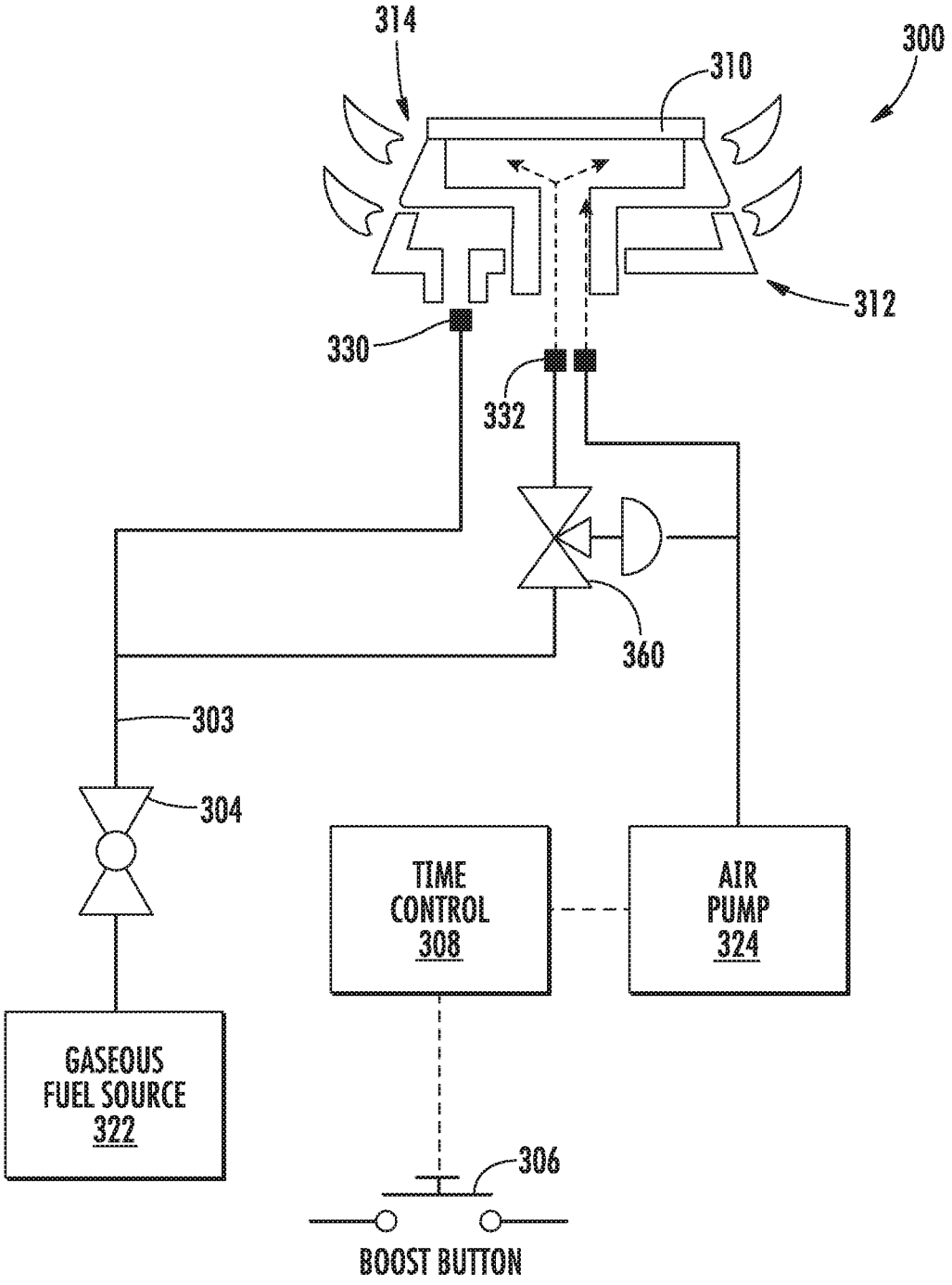
FIG. 2 is a schematic view of a gas burner according to an example embodiment of the present disclosure.
Figure 3:
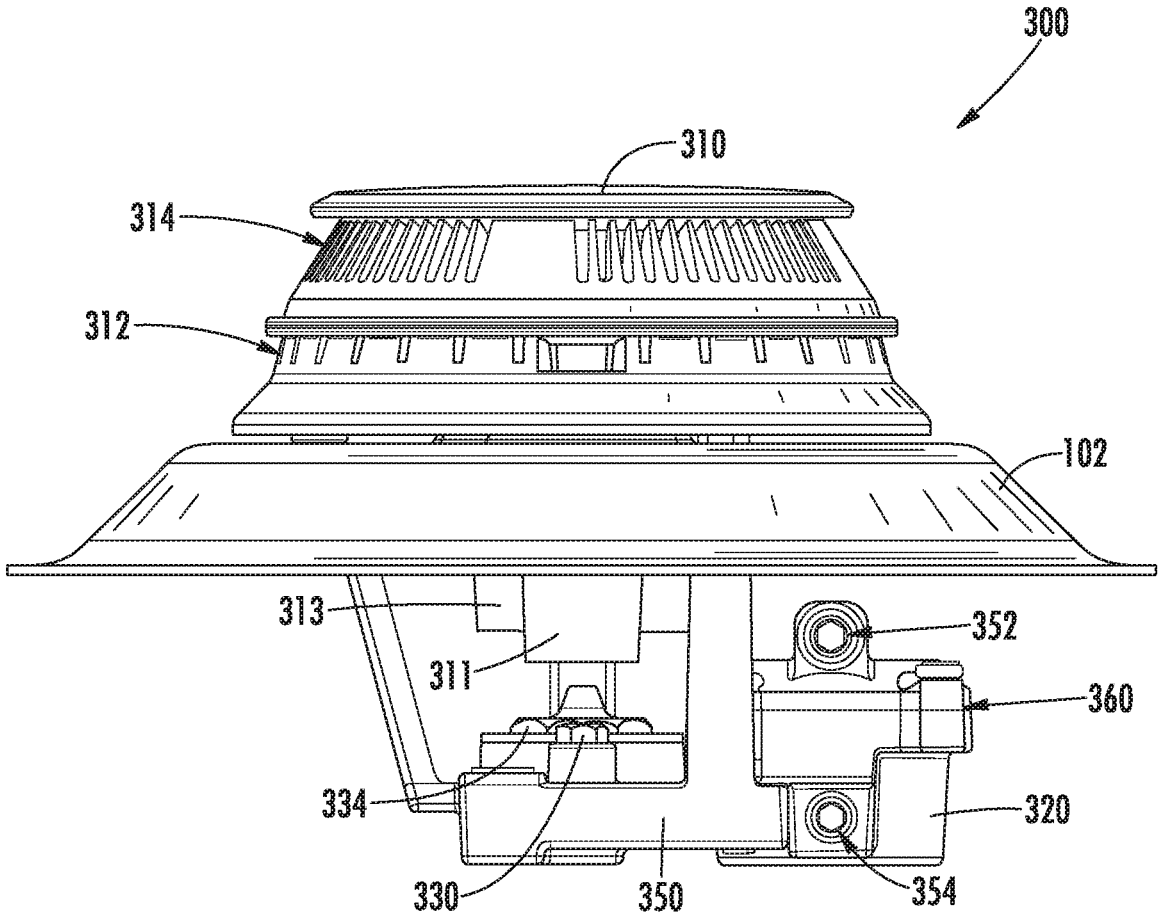
FIG. 3 is a side elevation view of the example gas burner of FIG. 2.
Figure 4:
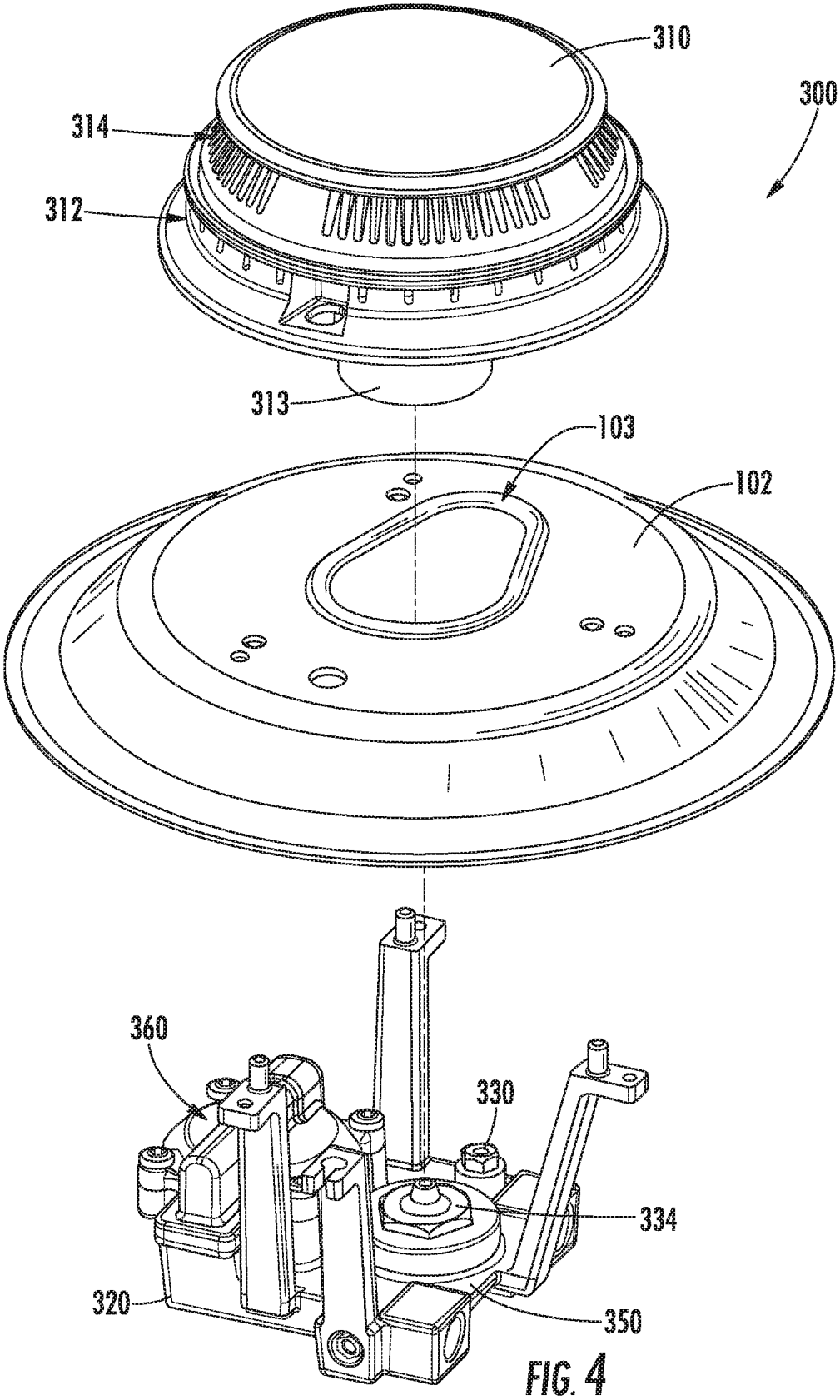
FIG. 4 is an exploded view of the example gas burner of FIG. 2.

Turning now to FIGS. 2 through 4, a gas burner 300 according to an example embodiment of the present disclosure is described. Gas burner 300 may be used in cooktop appliance 100, e.g., as one of gas burners 104. Thus, gas burner 300 is described in greater detail below in the context of cooktop appliance 100. However, it will be understood that gas burner 300 may be used in or with any other suitable cooktop appliance in alternative example embodiments.

Gas burner 300 includes a burner body 310. Burner body 310 defines a plurality of naturally aspirated flame ports 312 and a plurality of forced induction flame ports 314. Naturally aspirated flame ports 312 may be distributed in a ring on burner body 310. Similarly, forced induction flame ports 314 may be distributed in a ring on burner body 310. Burner body 310 may also be stacked, e.g., such that forced induction flame ports 314 are positioned above naturally aspirated flame ports 312 on burner body 310. Thus, e.g., the ring of forced induction flame ports 314 may be positioned above the ring of naturally aspirated flame ports 312 on burner body 310. Burner body 310 may be positioned on top panel 102.

Naturally aspirated flame ports 312 may receive gaseous fuel from a gaseous fuel source 322, such as a natural gas line or propane line, when a user actuates one of control knobs 108 to adjust a control valve 304. Thus, e.g., a supply line 303 for naturally aspirated flame ports 312 may extend from gaseous fuel source 322 to an orifice 330 for naturally aspirated flame ports 312, and control valve 304 may be coupled to supply line 303.

Forced induction flame ports 314 may be plumbed in parallel to naturally aspirated flame ports 312 in gas burner 300. Thus, forced induction flame ports 314 may be capable of receiving gaseous fuel from gaseous fuel source 322 when the user actuates one of control knobs 108 to adjust control valve 304. Gas burner 300 also includes features for supplying air from a pressurized air source 324, such as an air pump or fan, to forced induction flame ports 314. Thus, forced induction flame ports 314 may operate with a higher flow rate of gaseous fuel and/or air/fuel ratio compared to naturally aspirated flame ports 312. As an example, forced induction flame ports 314 may be activated by pressing a boost burner button 306 on control panel 106. In response to a user actuating boost burner button 306, pressurized air source 324 may be activated, e.g., with a timer control 308. Gas burner 300 also includes features for blocking the flow of gaseous fuel to forced induction flame ports 314 unless pressurized air source 324 is activated and/or pressurized air is supplied to forced induction flame ports 314, as discussed in greater detail below.

With reference to FIGS. 3 and 4, gas burner 300 also includes an injet assembly 320. Injet assembly 320 may be positioned below top panel 102, e.g., below an opening 103 of top panel 102. Conversely, burner body 310 may be positioned on top panel 102, e.g., over opening 103 of top panel 102. Thus, burner body 310 may cover opening 103 of top panel 102 when burner body 310 is positioned on top panel 102. When burner body 310 is removed from top panel 102, injet assembly 320 below top panel 102 is accessible through opening 103. Thus, e.g., a fuel orifice(s) of gas burner 300 on injet assembly 320 may be accessed by removing burner body 310 from top panel 102, and an installer may reach through opening 103 (e.g., with a wrench or other suitable tool) to change out the fuel orifice(s) of gas burner 300.

Injet assembly 320 is configured for directing a flow of gaseous fuel to naturally aspirated flame ports 312 of burner body 310. Thus, injet assembly 320 may be coupled to gaseous fuel source 322. During operation of gas burner 300, gaseous fuel from gaseous fuel source 322 may flow from injet assembly 320 into a vertical Venturi mixing tube 311. In particular, injet assembly 320 includes a first gas orifice 330 that is in fluid communication with a gas passage 354. A jet of gaseous fuel from gaseous fuel source 322 may exit injet assembly 320 at first gas orifice 330 and flow towards vertical Venturi mixing tube 311. Between first gas orifice 330 and vertical Venturi mixing tube 311, the jet of gaseous fuel from first gas orifice 330 may entrain air into vertical Venturi mixing tube 311. Air and gaseous fuel may mix within vertical Venturi mixing tube 311 prior to flowing to naturally aspirated flame ports 312 where the mixture of air and gaseous fuel may be combusted.

Injet assembly 320 is also configured for directing a flow of air and gaseous fuel to forced induction flame ports 314 of burner body 310. Thus, as discussed in greater detail below, injet assembly 320 may be coupled to pressurized air source 324 in addition to gaseous fuel source 322. During boosted operation of gas burner 300, a mixed flow of gaseous fuel from gaseous fuel source 322 and air from pressurized air source 324 may flow from injet assembly 320 into an inlet tube 313 prior to flowing to forced induction flame ports 314 where the mixture of gaseous fuel and air may be combusted at forced induction flame ports 314.

In addition to first gas orifice 330, injet assembly 320 also includes a mixed outlet nozzle 334 and an injet body 350. Injet body 350 defines an air passage 352 and a gas passage 354. Air passage 352 may be in fluid communication with pressurized air source 324. For example, a pipe or conduit may extend between pressurized air source 324 and injet body 350, and pressurized air from pressurized air source 324 may flow into air passage 352 via such pipe or conduit. Gas passage 354 may be in fluid communication with gaseous fuel source 322. For example, a pipe or conduit may extend between gaseous fuel source 322 and injet body 350, and gaseous fuel from gaseous fuel source 322 may flow into gas passage 354 via such pipe or conduit. In certain example embodiments, injet body 350 defines a single inlet for air passage 352 through which the pressurized air from pressurized air source 324 may flow into air passage 352, and injet body 350 defines a single inlet for gas passage 354 through which the pressurized air from gaseous fuel source 322 may flow into gas passage 354.

First gas outlet orifice 330 is mounted to injet body 350. Thus, gaseous fuel from gaseous fuel source 322 may exit gas passage 354 through first gas outlet orifice 330, and gas passage 354 is configured for directing a flow of gaseous fuel through injet body 350 to first gas outlet orifice 330. On injet body 350, first gas outlet orifice 330 is oriented for directing a flow of gaseous fuel towards vertical Venturi mixing tube 311 and/or naturally aspirated flame ports 312, as discussed above.

A second gas orifice 332 (FIG. 2) within injet body 350 and injet body 350, e.g., collectively, form an eductor mixer within injet body 350. The eductor mixer is configured for mixing pressurized air from air passage 352 with gaseous fuel from gas passage 354 in a mixing chamber below mixed outlet nozzle 334. In particular, a jet of pressurized air from pressurized air source 324 may flow from air passage 352 into the mixing chamber, and gaseous fuel from gaseous fuel source 322 may flow from gas passage 354 into the mixing chamber via second gas orifice 332. As an example, second gas orifice 332 may be a plate that defines a plurality of through holes, and the gaseous fuel in gas passage 354 may flow through the holes into the mixing chamber.

A mixture of air and gaseous fuel is formed within the mixing chamber. From the mixing chamber, the mixture of air and gaseous fuel may flow through mixed outlet nozzle 334. In particular, mixed outlet nozzle 334 is mounted to injet body 350 at the mixing chamber, and mixed outlet nozzle 334 is oriented on injet body 350 for directing the mixed flow of air and gaseous fuel from the mixing chamber into inlet tube 313 and/or towards forced induction flame ports 314, as discussed above.

Burner body 310 may be positioned over injet body 350, e.g., when burner body 310 is positioned top panel 102. In addition, first gas orifice 330 may be oriented on injet body 350 such that first gas orifice 330 directs the flow of gaseous fuel upwardly towards vertical Venturi mixing tube 311 and naturally aspirated flame ports 312. Similarly, mixed outlet nozzle 334 may be oriented on injet body 350 such that mixed outlet nozzle 334 directs the mixed flow of air and gaseous fuel upwardly towards inlet tube 313 and forced induction flame ports 314.

First and second gas orifices 330, 332 may be removeable from injet body 350. First and second gas orifices 330, 332 may also be positioned on injet body 350 directly below burner body 310, e.g., when burner body 310 is positioned on top panel 102. Thus, e.g., first and second gas orifices 330, 332 may be accessed by removing burner body 310 from top panel 102, and an installer may reach through opening 103 (e.g., with a wrench or other suitable tool) to change out first and second gas orifices 330, 332.

Injet assembly 320 also includes a pneumatically actuated gas valve 360. Pneumatically actuated gas valve 360 may be positioned within injet body 350, and pneumatically actuated gas valve 360 is adjustable between a closed configuration and an open configuration. In the closed configuration, pneumatically actuated gas valve 360 blocks the flow of gaseous fuel through gas passage 354 to mixed outlet nozzle 334. Conversely, pneumatically actuated gas valve 360 permits the flow of gaseous fuel through gas passage 354 to mixed outlet nozzle 334 in the open configuration. Pneumatically actuated gas valve 360 is configured to adjust from the closed configuration to the open configuration in response to the flow of air through air passage 352. Thus, e.g., pneumatically actuated gas valve 360 is in fluid communication with air passage 352 and opens in response to air passage 352 being pressurized by air from pressurized air source 324.

It will be understood that first gas outlet orifice 330 may be in fluid communication with gas passage 354 in both the open and closed configurations of pneumatically actuated gas valve 360. Thus, first gas outlet orifice 330 may be positioned on gas passage 354 upstream of pneumatically actuated gas valve 360 relative to the flow of gas through gas passage 354. Thus, e.g., pneumatically actuated gas valve 360 may not regulate the flow of gas through second gas orifice 332 but not first gas outlet orifice 330.

Figure 5:
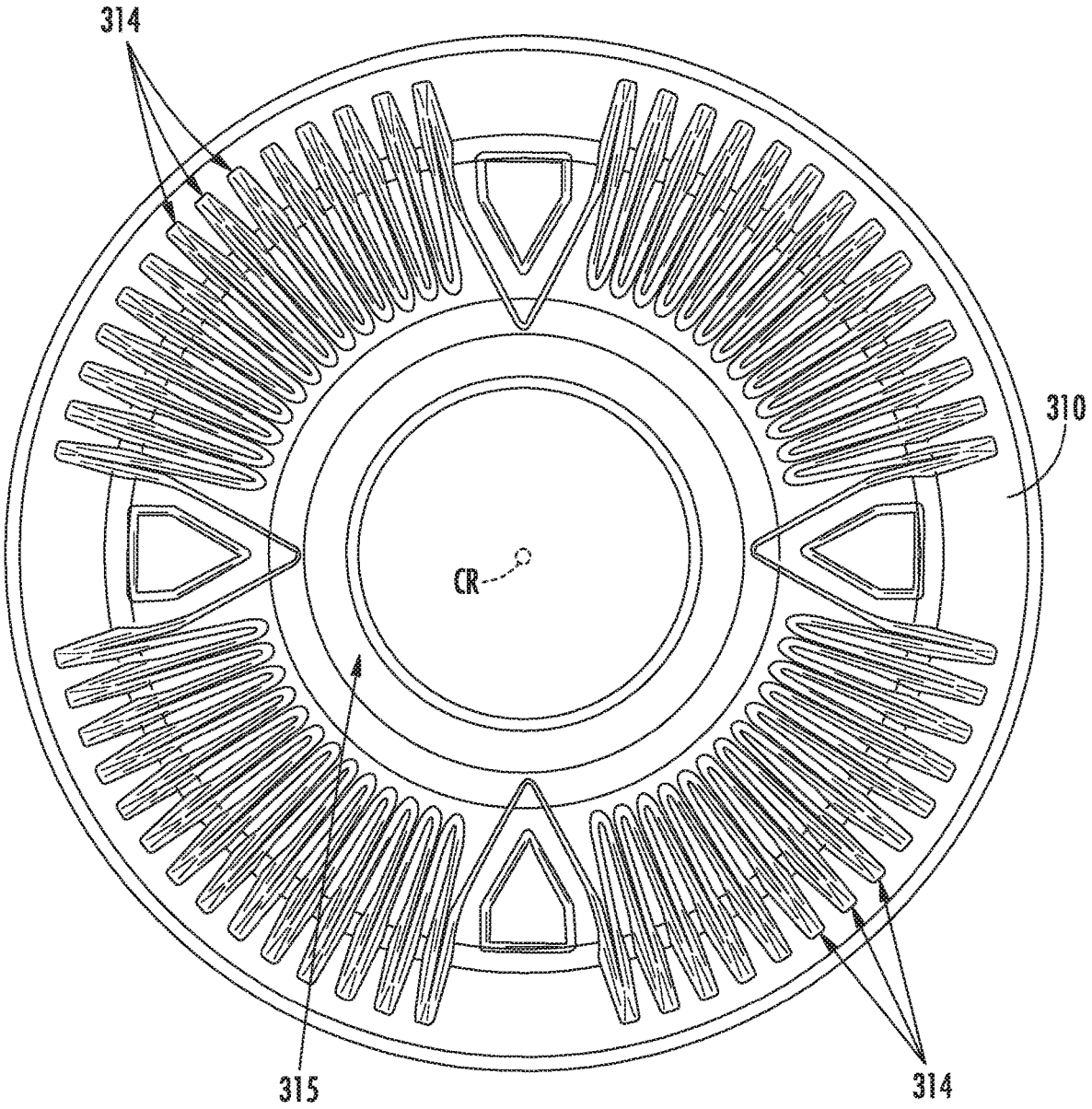
FIG. 5 is a top plan view of a burner body for the example gas burner of FIG. 2 according to another example embodiment of the present disclosure.
Figure 6:
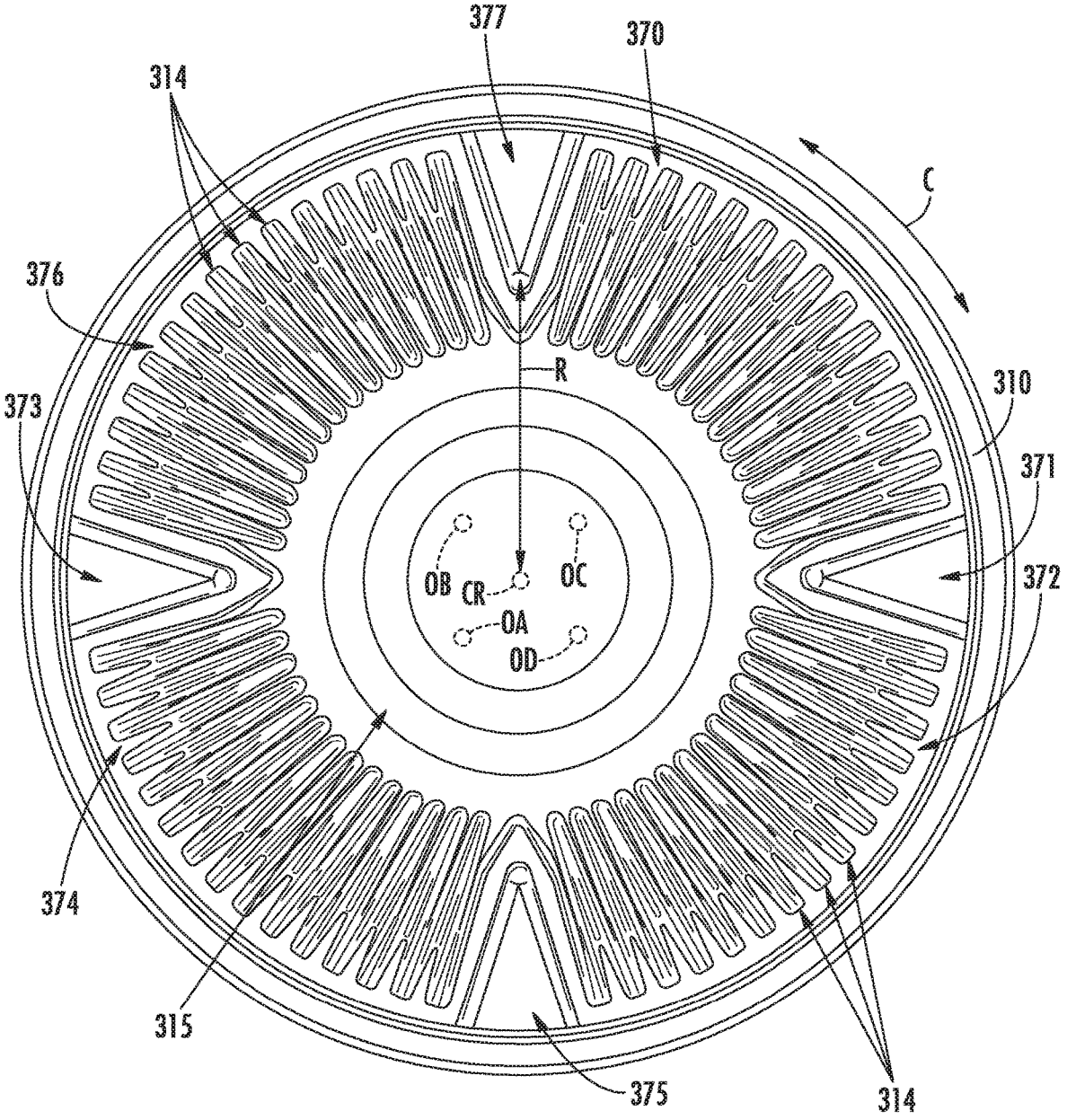
FIG. 6 is a top plan view of a burner body of the example gas burner of FIG. 2.
Figure 7:
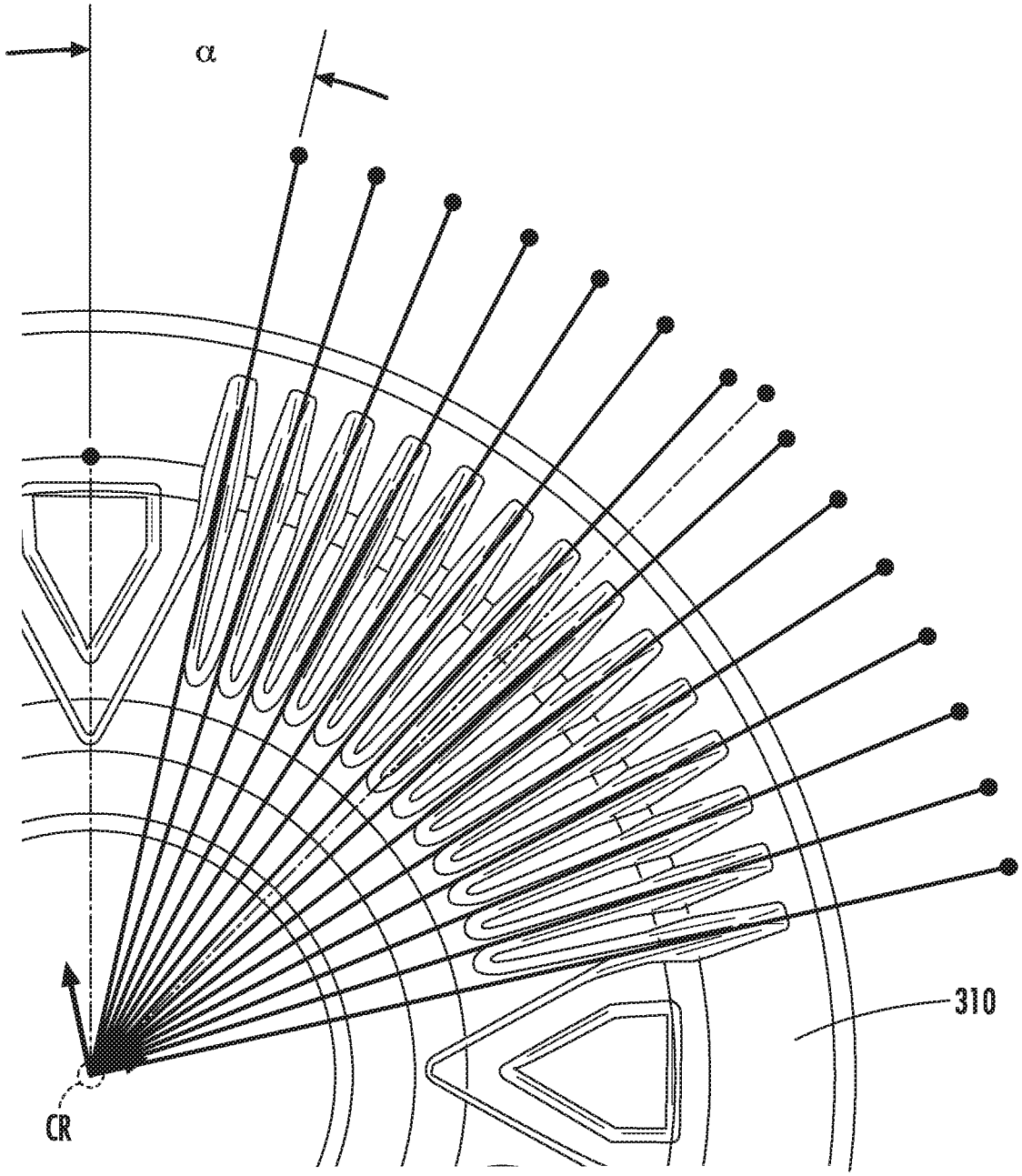
FIG. 7 is a section view of the example burner body of FIG. 5.
Figure 8:
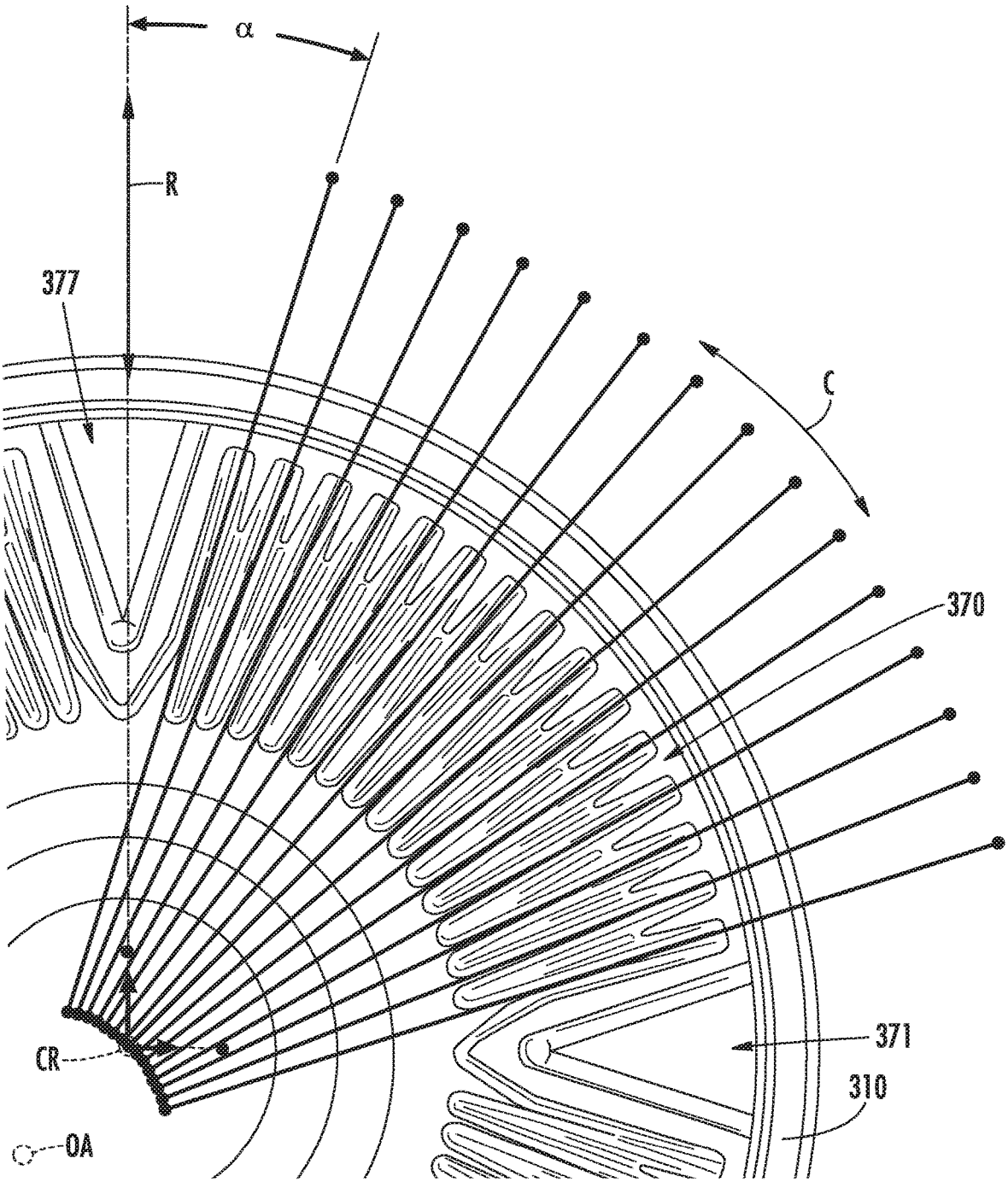
FIG. 8 is a section view of the burner body of FIG. 5.

FIG. 6 is a top plan view of burner body 310, and FIG. 8 is a section view of burner body 310. As discussed in greater detail below, burner body 310 includes features for limiting flames below a grate 110 (FIG. 1), e.g., an elongated member 112 of grate 110, above gas burner 100. FIG. 5 is a top plan view of a burner body 310 for gas burner 300 without the features for limiting flames below grate 110 above gas burner 100 shown in FIG. 6 and is provided by way of example as a contrast to burner body 310 shown in FIG. 6. FIG. 7 is a section view of the burner body 310 of FIG. 5.

As shown in FIGS. 6 and 8, burner body 310 defines a fuel chamber 315 and forced induction flame ports 314. Forced induction flame ports 314 are in fluid communication with fuel chamber 315, and fuel chamber 315 is in fluid communication with inlet tube 313. Thus, the mixed flow of gaseous fuel from gaseous fuel source 322 and air from pressurized air source 324 may flow from injet assembly 320 into inlet tube 313 and then into fuel chamber 315 prior to flowing outwardly through forced induction flame ports 314 where the mixture of gaseous fuel and air may be combusted at forced induction flame ports 314. It will be understood that, while described below in the context of forced induction flame ports 314, burner body 310 may also be configured to form naturally aspirated flame ports 312 in the same or similar manner to that described below for forced induction flame ports 314, e.g., in order to limit flames below grate 110 above gas burner 100.

Burner body 310 defines a circumferential direction C and a radial direction R. The circumferential direction C may extend around a center CR of fuel chamber 315 (e.g., that is also a radial center of the gas burner 300), and the radial direction R may extend from the center CR of fuel chamber 315. Forced induction flame ports 314 are distributed along the circumferential direction on burner body 310, e.g., such that forced induction flame ports 314 are uniformly spaced from the center CR of fuel chamber 315 along the radial direction R.

Forced induction flame ports 314 may include a first flame port polar array 370 and a second flame port polar array 372. Each of the first and second flame port polar arrays 370, 372 includes two or more forced induction flame ports 314. First and second flame port polar arrays 370, 372 are spaced by a first void 371 along the circumferential direction C. Thus, e.g., first void 371 may be positioned between first and second flame port polar arrays 370, 372 along the circumferential direction C. First void 371 may correspond to a gap in an otherwise continuous array of forced induction flame ports 314 along the circumferential direction C. First void 371 may be positioned directly below grate 110, e.g., an elongated member 112 of grate 110, above gas burner 100, in order to limit flames from forced induction flame ports 314 being positioned below grate 110. A width of first void 371, e.g., along the circumferential direction C, may correspond to the width an elongated member 112 of grate 110 above first void 371. The width of first void 371, e.g., along the circumferential direction C, may also be greater than the collective width of two or more of forced induction flame ports 314.

First flame port polar array 370 has an origin OA that is spaced from the center CR of fuel chamber 315. Each of the forced induction flame ports 314 in first flame port polar array 370 may have a center line that intercepts the origin OA of first flame port polar array 370. Thus, as shown in FIG. 8, the center lines (shown with the dot-dot lines in FIG. 8) of forced induction flame ports 314 in first flame port polar array 370 extend from the origin OA of first flame port polar array 370 rather than extending along the radial direction R from the center CR of fuel chamber 315 as shown in FIG. 7.

The center line of a middle flame port in in first flame port polar array 370 may pass through the center CR of fuel chamber 315, e.g., along the radial direction R. Thus, e.g., the center CR of fuel chamber 315 may be positioned between the origin OA of first flame port polar array 370 and first flame port polar array 370. The origin OA of first flame port polar array 370 may be spaced from the center CR of fuel chamber 315 by any suitable amount. For example, the origin OA of first flame port polar array 370 may be spaced from the center CR of fuel chamber 315 by no less than a quarter of an inch (0.25 in.) along the radial direction R.

As shown in FIG. 8, a center line of a flame port 314 in first flame port polar array 370 that is adjacent first void 371 may define an angle $\alpha$ with a line along the radial direction R that extends from the center CR of fuel chamber 315 through a middle of the first void 371. The angle $\alpha$ may be about seventeen and a half degrees (17.5°). As used herein, the term "about" means within a half degree (0.5°) of the stated angle when used in the context of angles. In contrast, with reference to FIG. 7, the angle $\alpha$ may be about twelve and three-quarters degrees (12.75°) when the center lines of forced induction flame ports 314 extend along the radial direction R from the center CR of fuel chamber 315.

Second flame port polar array 372 also has an origin OB that is spaced from the center CR of fuel chamber 315. In addition, the origin OB of second flame port polar array 372 may be spaced from the origin OA of first flame port polar array 370. Each of the forced induction flame ports 314 in second flame port polar array 372 may have a center line that intercepts the origin OB of second flame port polar array 372. Thus, rather than extending along the radial direction R from the center CR of fuel chamber 315, the center lines of forced induction flame ports 314 in second flame port polar array 372 extend from the origin OB of second flame port polar array 372.

The center line of a middle flame port in in second flame port polar array 372 may pass through the center CR of fuel chamber 315, e.g., along the radial direction R. Thus, e.g., the center CR of fuel chamber 315 may be positioned between the origin OB of second flame port polar array 372 and second flame port polar array 372. The origin OB of second flame port polar array 372 may be spaced from the center CR of fuel chamber 315 by any suitable amount. For example, the origin OB of second flame port polar array 372 may be spaced from the center CR of fuel chamber 315 by no less than a quarter of an inch (0.25 in.) along the radial direction R. In addition, the origin OB of second flame port polar array 372 may be spaced from the origin OA of first flame port polar array 370 by any suitable amount. For example, the origin OB of second flame port polar array 372 may be spaced from the origin OA of first flame port polar array 370 by no less than a quarter of an inch (0.25 in.), in certain example embodiments.

It will be understood that forced induction flame ports 314 may be distributed with any suitable number of polar flame port polar array and corresponding voids. In the example embodiment shown in FIG. 6, burner body 310 is formed such that forced induction flame ports 314 has four flame port polar arrays and four voids. However, burner body 310 may formed such that forced induction flame ports 314 has two flame port polar arrays and two voids, three flame port polar arrays and three voids, five flame port polar arrays and five voids, etc.

As noted above, burner body 310 may be formed such that forced induction flame ports 314 has four flame port polar arrays and four voids. Thus, as shown in FIG. 6, burner body 310 may also include a third flame port polar array 374 and a fourth flame port polar array 376. Third and fourth flame port polar arrays 374, 376 are spaced by a second void 373 along the circumferential direction C. Thus, e.g., second void 373 may be positioned between third and fourth flame port polar arrays 374, 376 along the circumferential direction C. Second void 373 may correspond to a gap in an otherwise continuous array of forced induction flame ports 314 along the circumferential direction C. Second void 373 may be positioned directly below another portion of grate 110, e.g., another elongated member 112 of grate 110, above gas burner 100, in order to limit flames from forced induction flame ports 314 being positioned below grate 110. In the same or similar manner to that described above for first and second voids 371, 373, second and third flame port polar arrays 372, 374 may be spaced by a third void 375 along the circumferential direction C, and first and fourth flame port polar arrays 370, 376 may be spaced by a fourth void 377 along the circumferential direction C.

Each of the third and fourth flame port polar arrays 374, 376 may have a respective origin OC, OD that is spaced from the center CR of fuel chamber 315, e.g., in the manner described above for first and second flame port polar arrays 370, 372. The origin OC of third flame port polar array 374 may also be spaced from the origin OA of first flame port polar array 370, the origin OB of second flame port polar array 372 and the origin OD of fourth flame port polar array 374.

As may be seen from the above, gas burner 300 may be outwardly firing and have a number of voids spaced about the radial center of the gas burner 300, and a respective polar flame port array is positioned between each pair of voids. An origin of each polar flame port array is spaced or offset from the radial center of gas burner 300. Such orientations of the flame ports may result in gaseous fuel exiting the flame ports have a stronger radial velocity component and a weaker tangential velocity component perpendicular to the radial velocity component and towards the voids, relative to the radially centered arrays shown in FIGS. 5 and 7. Thus, the flames at the adjacent the voids in the polar flame port arrays may be more radially oriented compared to radially centered arrays to avoid excessively heating a grate above gas burner 300.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner, comprising a burner body defining a fuel chamber and a plurality of flame ports, the plurality of flame ports configured for directing a flow of fuel and air out of the fuel chamber, the plurality of flame ports distributed along a direction on the burner body, wherein the plurality of flame ports comprises a first flame port polar array and a second flame port polar array, the first and second flame port polar arrays spaced by a void along the circumferential direction, the first flame port polar array having an origin that is spaced from the center of the fuel chamber, the second flame port polar array having an origin that is spaced from the center of the fuel chamber and from the origin of the first flame port polar array, wherein the burner body is a round burner body.

2. The gas burner of claim 1, further comprising an air handler operable to force air into the fuel chamber.

3. The gas burner of claim 1, wherein the plurality of flame ports further comprises a third flame port polar array and a fourth flame port polar array, the void being a first void, the third and fourth flame port polar arrays spaced by a second void along the circumferential direction, the third flame port polar array having an origin that is spaced from the center of the fuel chamber and the origins of the first and second flame port polar arrays, the fourth flame port polar array having an origin that is spaced from the center of the fuel chamber and from the origins of the first, second and third flame port polar array.

4. The gas burner of claim 3, wherein the second and third flame port polar arrays are spaced by a third void along the circumferential direction, and the first and fourth flame port polar arrays are spaced by a fourth void along the circumferential direction.

5. The gas burner of claim 1, wherein the origins of the first and second flame port polar arrays are each spaced from the center of the fuel chamber by no less than a quarter of an inch along the radial direction.

6. The gas burner of claim 1, wherein the center of the fuel chamber is positioned between the origin of the first flame port polar array and the first flame port polar array, and the center of the fuel chamber is positioned between the origin of the second flame port polar array and the second flame port polar array.

7. The gas burner of claim 1, further comprising a grate positioned over the burner body, the void positioned directly below an elongated member of the grate.

8. The gas burner of claim 1, wherein the plurality of flame ports are oriented for directing the flow of fuel and air outwardly along the radial direction.

9. The gas burner of claim 1, wherein the plurality of flame ports are distributed in a ring on the burner body.

10. A gas burner, comprising a burner body defining a fuel chamber and a plurality of flame ports, the plurality of flame ports configured for directing a flow of fuel and air out of the fuel chamber, the plurality of flame ports distributed along a circumferential direction on the burner body, wherein the plurality of flame ports comprises a first pair of adjacent flame ports and a second pair of adjacent flame ports, the first pair of adjacent flame ports positioned opposite the second pair of adjacent flame ports about a void along the circumferential direction, each of the first and second pairs of adjacent flame ports extending along a respective centerline, the centerlines of the first pair of adjacent flame ports intersecting at a first point that is spaced from the center of the fuel chamber, the centerlines of the second pair of adjacent flame ports intersecting at a second point that is spaced from the center of the fuel chamber and from the first point, wherein the burner body is a round burner body.

11. The gas burner of claim 10, further comprising an air handler operable to force air into the fuel chamber.

12. The gas burner of claim 10, wherein the center of the fuel chamber is positioned between the first point and the first pair of adjacent flame ports along the radial direction.

13. The gas burner of claim 10, wherein:

the void is a first void;

the plurality of flame ports further comprises a third pair of adjacent flame ports and a fourth pair of adjacent flame ports;

the third pair of adjacent flame ports positioned opposite the fourth pair of adjacent flame ports about a second void along the circumferential direction; and each of the third and fourth pairs of adjacent flame ports extending along a respective centerline, the centerlines of the third pair of adjacent flame ports intersecting at a third point that is spaced from the center of the fuel chamber and from the first and second points, the centerlines of the fourth pair of adjacent flame ports intersecting at a fourth point that is spaced from the center of the fuel chamber and from the first, second and third points.

14. The gas burner of claim 10, wherein the first point is spaced from the center of the fuel chamber by no less than a quarter of an inch along the radial direction.

15. The gas burner of claim 10, further comprising a grate positioned over the burner body, the void positioned directly below an elongated member of the grate.

16. The gas burner of claim 10, wherein the plurality of flame ports are oriented for directing the flow of fuel and air outwardly along the radial direction.

17. The gas burner of claim 10, wherein the plurality of flame ports are distributed in a ring on the burner body.

* * * * *